US009463560B2

(12) United States Patent
Largo

(10) Patent No.: US 9,463,560 B2
(45) Date of Patent: Oct. 11, 2016

(54) PORTABLE PRESSURIZED POWER SOURCE FOR FASTENER DRIVING TOOL

(75) Inventor: Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 744 days.

(21) Appl. No.: 13/618,034

(22) Filed: Sep. 14, 2012

(65) Prior Publication Data

US 2013/0082085 A1 Apr. 4, 2013

Related U.S. Application Data

(60) Provisional application No. 61/542,506, filed on Oct. 3, 2011.

(51) Int. Cl.
*B25C 1/04* (2006.01)
*B65D 83/32* (2006.01)

(52) U.S. Cl.
CPC ..... *B25C 1/04* (2013.01); *B65D 83/32* (2013.01)

(58) Field of Classification Search
CPC ..... B25C 1/04; B25C 5/13; B25C 3/00
USPC ..... 227/8, 10, 130, 131; 173/169; 220/581
See application file for complete search history.

(56) References Cited

U.S. PATENT DOCUMENTS 3,211,349 A 10/1965 Prussin et al.
4,211,352 A * 7/1980 Zilka ..... B25C 1/043 227/130
4,483,461 A * 11/1984 Igarashi ..... 222/3
5,797,522 A 8/1998 Evans et al.
6,223,966 B1 * 5/2001 Nayrac ..... B25C 1/08 123/46 SC
6,311,887 B1 * 11/2001 Walter ..... 227/10
6,431,425 B1 8/2002 Moorman et al.
6,786,379 B2 * 9/2004 Largo ..... B25C 1/04 123/46 SC
6,876,379 B1 4/2005 Fisher
7,063,247 B1 * 6/2006 Lund et al. ..... 227/10
2003/0127238 A1 7/2003 Largo
2004/0074929 A1 4/2004 Yquel
2005/0252944 A1 11/2005 Patrick
2005/0253105 A1 * 11/2005 Gardner et al. ..... 251/144
2008/0135598 A1 * 6/2008 Burke et al. ..... 227/130
2008/0185416 A1 8/2008 Deng et al.
2009/0166359 A1 * 7/2009 Pisot ..... 220/203.29
2010/0124692 A1 5/2010 Schiestl

FOREIGN PATENT DOCUMENTS

FR 1467954 2/1967
FR 2707265 1/1995
GB 2467579 8/2010

OTHER PUBLICATIONS

International Search Report for corresponding International Application PCT/US2012/58404.

* cited by examiner

*Primary Examiner* — Nathaniel Chukwurah
(74) *Attorney, Agent, or Firm* — Neal, Gerber & Eisenberg LLP

(57) ABSTRACT

A pressurized fluid container for use with a fastener-driving tool, the container having an outer shell defining an inner chamber, having an open neck and an effective height, a closure sealingly engaged on the open neck, and a tube depending from the closure.

5 Claims, 7 Drawing Sheets

PORTABLE PRESSURIZED POWER SOURCE FOR FASTENER DRIVING TOOL

RELATED APPLICATION

This application claims priority under 35 USC 119(e) from U.S. Provisional Application Ser. No. 61/542,506 filed Oct. 3, 2011 and is related to U.S. Nonprovisional application Ser. No. 13/617,971 filed on Sep. 14, 2012 and deriving priority from U.S. Provisional Application Ser. No. 61/542,504 filed Oct. 3, 2011, the contents of which are incorporated by reference herein.

BACKGROUND

The present invention relates generally to fastener driving tools, and more specifically to such a tool having a pre-pressurized power delivery source.

Power tools for use in driving fasteners into work pieces are known in the art. Such tools can be operated by a variety of power sources, including pneumatic, combustion, electric or powder-activated power sources. In some power tools, the power source is integrated with a housing of the tool for easy portability. Other applications require power to be fed with a feed line from an external source, such as pneumatic tools operated by an air compressor.

Fastener driving tools of this type, and particularly pneumatically powered tools, include a metal housing and a magazine portion that is attached to the housing and/or the handle. Generally, the magazine retains a supply of fasteners which are fed to a drive track in the housing configured for receiving and guiding a fastener as it is driven by a reciprocating piston and driver blade from the drive track into a work piece.

A suitable pneumatically powered fastener-driving tool with a portable power source is disclosed in U.S. Pat. No. 6,876,379, which is incorporated by reference. In such a tool, the tool housing defines a main chamber having a cylinder for accommodating reciprocation of the driver blade and piston. The driving stroke of the piston moves a driver blade in the drive track that impacts a fastener to drive the fastener into a work piece. The piston is powered by a pneumatic power source, most preferably a portable container or vessel of compressed gas such as carbon dioxide or the like, which forces the piston in a driving direction under operator control through pulling of a trigger. The piston also configured to be oppositely driven by a partial vacuum or other known apparatus in a return stroke to the retracted or pre-driving position.

One drawback of conventional tools of this type is that the mechanical mechanism used to trigger and power the fastener driving power cycle is relatively inefficient in the use of the limited supply of compressed gas. A main result is that the operational life of such tools is relatively short and unacceptable to many users. As such, this type of tool has had a limited commercial application.

SUMMARY

The present, preferably pressurized fluid-powered fastener driving tool addresses the drawbacks of previous tools of this type and features an electrical control circuit or program connected to a solenoid valve for more accurate dosing of the compressed fluid, preferably a gas, used to power the tool. The control program, preferably incorporated in a microprocessor, is connected to the solenoid valve to control the flow of fluid to a piston and driver blade for driving a fastener. A periodic opening of the solenoid under electrical control enhances the efficient use of the compressed fluid in the container. The opening time (which can be user adjustable) results in a quantity of fluid being introduced into the drive cylinder to act upon the drive piston and subsequently drive the fastener. The tool is optionally configured for returning the piston via an urging member using energy stored during the driving stroke, or by re-directing the drive gas volume to the underside of the drive piston. Alternately, a small amount of additional fluid may be directed to the underside of the piston to accomplish return. A combination of two or more of the described methods is also contemplated.

In addition, the compressed gas used to drive the piston and driver blade in the fastener driving process is optionally retained in the tool and recycled for both returning the piston to the initial position and for use in driving subsequent fasteners. This return may be supplemented or replaced by a mechanical return such as a resilient bumper and a return spring. As a result, the portable compressed fluid supply in the present tool lasts longer than conventional tools.

Another feature of the present fastener-driving tool relates to the operational attribute of such compressed power sources, in that the container includes a supply of pressurized liquid along with the supply of compressed gas. When the tool is designed to be powered by compressed gas, in the event the liquid flows into the tool, performance is impeded. To address this problem, the compressed power source is provided with an anti-siphon device for preventing the flow of compressed liquid into the tool. Such an anti-siphon device is designed for use in either a reusable or a disposable pressurized container. In some embodiments, the anti-siphon tube is provided with specialized structures for impeding the flow of pressurized liquid into the tube, including a drip shelf, a bottom end with a restricted opening, and a depending protective ring.

More specifically, a pressurized fluid container is provided for use with a fastener-driving tool, the container having an outer shell defining an inner chamber, having an open neck and an effective height, a closure sealingly engaged on the open neck, and a tube depending from the closure.

In another embodiment, a driver tool powered by compressed gas is provided, including a magazine for storing and supplying fasteners to a tool nose, a cylinder with a reciprocating piston attached to a driver blade, and a compressed gas container being in fluid communication with the reciprocating piston and having an anti-siphon tube.

In still another embodiment, a pressurized fluid container is provided. The container includes an outer shell defining an inner chamber, having an open neck and an effective height, a closure sealingly engaged on the open neck, a flexible tube depending from the closure, and a float attached to a free end of the tube and in contact with a liquid phase of a fluid in the container.

DETAILED DESCRIPTION

Figure 1:
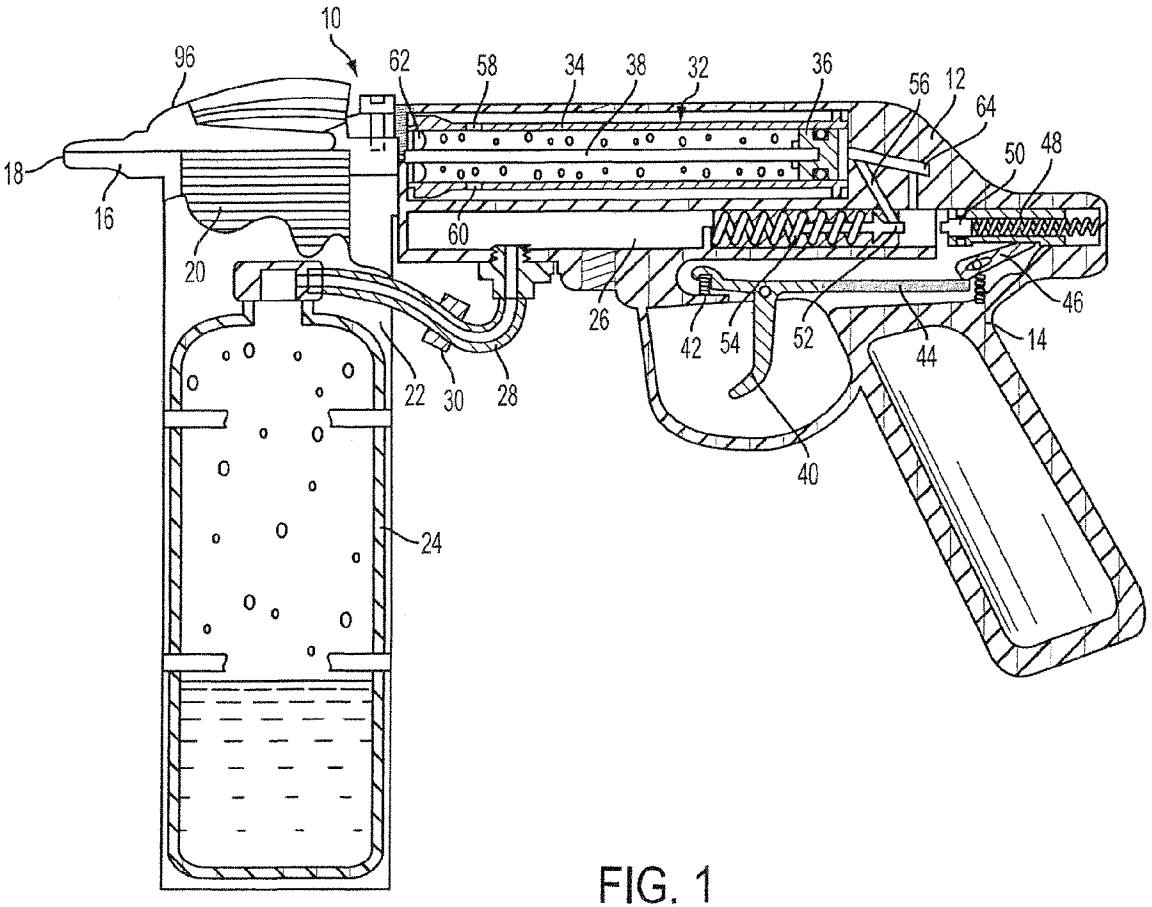
FIG. 1 PRIOR ART
FIG. 1 is a vertical section of a prior art fastener tool powered by a portable compressed fluid source.

Referring now to FIG. 1, a suitable prior art fastener-driving tool that is compatible with the present invention is generally designated 10. This tool is described in greater detail in commonly-assigned U.S. Pat. No. 6,786,379 which is incorporated by reference. However, it is also contemplated that the present invention is applicable in other types of pneumatically powered fastener-driving tools that are well known in the art, and is not limited to the illustrated embodiment. The tool 10 includes a grip frame or housing 12, made of a variety of materials, but preferably metal to withstand the forces generated by pressurized gas contained within. It is contemplated that the housing 12 be provided in a variety of configurations, both enclosed and open, frame-style to provide a mounting point for the various tool components discussed below. Included in the housing 12 is a handle 14, and a tool nose 16 having a shear block and defining an outlet 18 for the passage of fasteners 20 into a work piece. It is also contemplated that the housing 12 may take a variety of shapes and optionally partially, rather than completely encloses at least some of the tool components.

A fastener storage device or magazine 22 retains a supply of the fasteners 20 and includes a biasing element (not shown) for urging the fasteners toward the nose 16. While a strip-style magazine 22 is depicted, other conventional fastener storage device types are contemplated, including but not limited to rotary or coil magazines.

Preferably removably secured to the magazine 22 for support and replacement purposes is a portable vessel or container 24 of pressurized fluid, which is contemplated as being a pressurized gas, preferably carbon dioxide ($CO_2$) or nitrous oxide ($N_2O$). Other pressurized gases are contemplated, including nitrogen ($N_2$) and air. The following description of a preferred embodiment utilizes self contained pre-pressurized $CO_2$ in a two-phase mixture as the power source. An advantage of using a two-phase mixture of $CO_2$ is that when the mixture is stored in the removable container 24 that is in equilibrium and has two phases of $CO_2$ remaining in the vessel, a constant pressure of the gas phase is maintained. That is, as gaseous $CO_2$ is removed from the vessel 24 to power the fastener-driving tool 10, liquid $CO_2$ changes to a gas phase to replace lost gaseous $CO_2$ and maintain a constant pressure in the vessel. Another advantage of using a pressurized power source such as $CO_2$ is that, due to the relatively high pressure of the gas (in the range of 800 psi), the number and size of the moving tool parts can be reduced. This reduces the likelihood of experiencing a mechanical failure, simplifies repairs, and lowers the overall manufacturing costs. It is also contemplated that the tool 10 is optionally powered by the pressurized liquid phase of $CO_2$. Fluid communication between the gas container 24 and an inner chamber 26 of the housing 12 is effected by a conduit 28, here a flexible hose; however other conduits are contemplated, as well as a direct connection between the container 24 and the housing 12. An optional adjustable regulator 30 reduces pressure within the inner chamber 26 to approximately 400 psi or other pressures as known to those skilled in the art.

A pneumatic engine 32 includes a cylinder 34 enclosing a reciprocating piston 36 attached to a driver blade 38. Depending on the application, the piston 36 and the drive blade 38 are separate parts fastened together or are integrally joined. As is known in the art, reciprocation of the driver blade 38 in a passageway (not shown) defined by the tool nose 16 drives fasteners 20 out the outlet 18. Compressed gas provided by the container 24 fills and pressurizes the inner chamber 26.

A mechanical linkage controls the flow of compressed fluid within the inner chamber and powers the reciprocal action of the piston 36 and the driver blade 38. Included in this linkage is a pivoting trigger 40 which is biased, preferably by a spring 42, or by magnets or other known structures. A trigger arm 44 engages a biased sear 46 which in turn releases a biased activating bolt or valve opening member 48 that is held in place by the internal pneumatic pressure of the inner chamber 26. A trigger piston 50 at an end of the valve-opening member 48 engages a respective stem 52 of a counter-biased control valve 54 for periodically opening a supply port 56 for pressurizing the piston 36 to initiate a fastener-driving cycle.

As is known in the art, as the piston 36 is driven down the cylinder 34, pressurized gas is vented through escape ports 58 in communication with a return chamber 60 that temporarily stores the pressurized gas which is then used to return the piston 36 to the start position depicted in FIG. 1. Pressurized gas can also be provided directly from the container 24 for assisting in return of the piston 36. Piston return is also facilitated by a resilient rubber-like bumper 62 located at an end of the cylinder 34 closest to the tool nose 16. As the piston 36 returns to the start position, gas ahead of the piston is vented to atmosphere from the cylinder through a main port 64, which also receives the pressurized gas released by the control valve 54 at the beginning of the driving cycle. It has been found that the above-described system is relatively inefficient in the use of pressurized gas, and thus limits the operational life of the gas container 24 and impairs the commercial adaptability of the tool 10.

Figure 2:
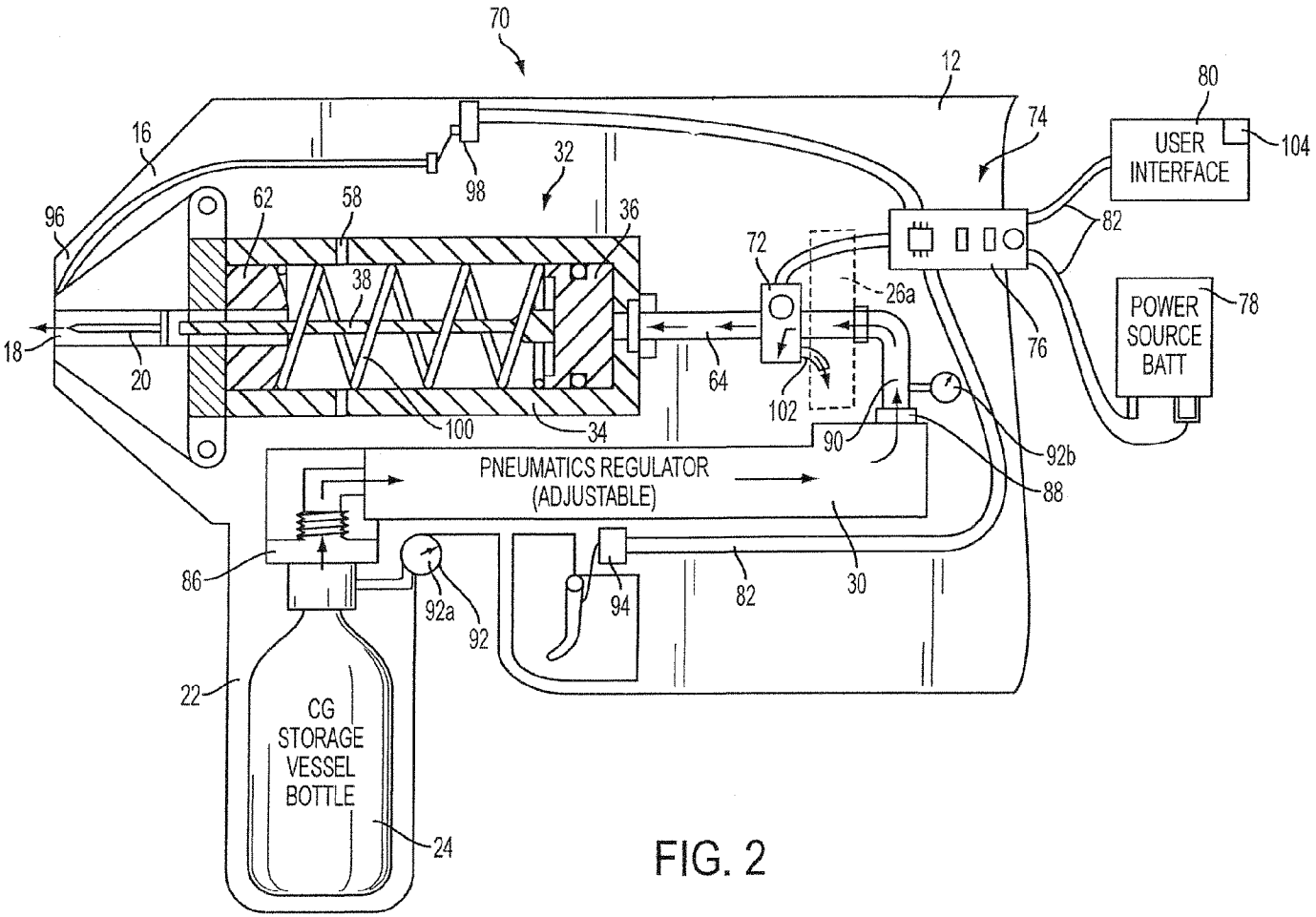
FIG. 2 is a fragmentary schematic of the present tool.

Referring now to FIG. 2, the present pneumatic drive system is incorporated into a fastener-driving tool generally designated 70. Components shared with the tool 10 are designated with identical reference numbers. The present fastener driver tool 70 includes the following major component groups. These are: the fluid storage vessel 24, the pressure regulator 30, an electro-mechanical solenoid valve 72, the drive cylinder 34 and the piston 36, associated electrical control system, program or control circuitry (all three are considered equivalent or synonymous) 74 and the conventional magazine 22 and the associated fastener feeder mechanism.

An important feature of the present tool 70 relates to the use of the control circuitry 74 that is operatively associated with the housing 12 and is configured for electrically controlling a flow of compressed fluid for driving the piston 36. In the preferred embodiment, this control is achieved by at least one microprocessor 76 or similar control module powered by a power source 78, preferably a battery or other conventional power source, and preferably having a user interface 80. The battery 78 and the interface 80 are preferably connected to the control system 76 via wiring 82, or optionally wirelessly, as feasible. The electro-magnetic solenoid valve 72 is electrically connected to the control system 76 via the wiring 82 and is operationally disposed relative to the supply port 56 or the main port 64 as is known in the art of pneumatic power technology for directly controlling the flow of pressurized fluid to the piston 36.

Through the user interface 80, the user can adjust the performance of the tool 70, including among other things the duration of energization time of the solenoid valve 72. Depending on the application, additional energization time provides more driving power to the fastener 20 which may be needed for longer fasteners and/or for harder substrates. As is known in the art, the user interface 80 may include a visual display, LED indicators, a touch screen, user actuated buttons and similar control interfaces.

In the tool 70, the pressurized fluid container 24 is directly connected to the tool housing 12 through a fitting 86 that in turn is in fluid communication with the regulator 30. Thus, the conduit 28 is eliminated as shown, but is contemplated as an option in the event the user wishes to personally carry the container 24 to reduce the weight of the tool 70. An outlet 88 of the regulator 30 is in fluid communication with a solenoid intake tube 90. If desired, a pressure sensor and gauge 92 is optionally located in the relatively low-pressure intake tube 90, and/or at the relatively high pressure mounting fitting 86 for monitoring pneumatic pressure between the container 24 and the intake tube 90. As is the case in the tool 10, the regulator 30 is adjustable for changing operational pressures as needed.

A further feature of the present tool 70 is that the control system 74 is optionally programmed to receive and compare pressure data from the respective pressure sensors/gauges 92 located in the flow path before and after the regulator 30, the gauges respectively identified as 92*a* and 92*b*. Each of the gauges 92*a*, 92*b* is electrically connected to the control system 74, and the micro processor 76 is configured to compare the transmitted pressure data. In the event both gauges transmit a similar pressure value, the significance is that the container 24 is close to being empty, and the user has a limited number of fasteners that can be driven before a refill container is obtained. The control system 74 is configured such that the user interface 80 displays or emits an alarm to the user to replace the container 24. It is contemplated that the alarm is visual and/or audible and/or sensory. The precise pressure value that triggers the alarm may vary to suit the situation.

Another feature of the tool 70 is that the trigger 40 is electrically connected to the control system 74 through a switch 94, which is preferably a micro switch or similar switching device, such as an optical or magnetically triggered switch, and suitable wiring 82. Upon closing of the switch 94, the control system 74 energizes the solenoid valve 72 for periodically opening and allowing a dose of pressurized fluid from the container 24. The period of time of energization of the valve 72 is user adjustable via the user interface 80.

Also, as is common in fastener driving tools, the nose 16 is equipped with a reciprocating work piece contact element (WCE) 96 that retracts relative to the nose 16 to permit the driving of a fastener 20. In the tool 70, the WCE 96 is electrically connected to a switch 98, similar to the switch 94 and preferably a micro switch or similar switch that is triggered by WCE movement, such as magnetically or optically, for sending a signal to the control system 74. Preferably, the microprocessor 76 is programmed so that the solenoid valve 72 will open only when the switches 94 and 98 are closed or otherwise energized. The specific order of energization of the switches 94, 98 may vary to suit the desired operation of the tool 70. For so-called sequential operation, the microprocessor 76 is configured such that the switch 98 is energized before the micro switch 94. Alternatively, in so-called repetitive operation, the micro switch 94 is energized before the micro switch 98. The microprocessor 76 is programmed to provide a sufficient energization time for the solenoid valve 72 to enable the piston 36 to reach the opposite end of the cylinder 34 adjacent the bumper 62. At the expiration of the allotted time period, the valve 72 is then closed, shutting off the flow of pressurized gas and enabling piston return.

To enhance piston return at the end of the driving cycle, in addition to the bumper 62 and pneumatic return, the present tool 70 is optionally equipped with an in-cylinder return spring 100 which biases the piston 36 to the start position shown in FIG. 2. Preferably, the return spring 100 is of the helical type which surrounds the driver blade 38; however other configurations are contemplated. The biasing force of the spring 100 is selected so as not to appreciably impair the driving force of the piston 36. As the piston 36 is returned, any residual gas above or in front of the piston is vented to atmosphere through an exhaust port 102 in the solenoid valve 72.

Still another feature of the tool 70 is at least one tool condition indicator 104, shown on the user interface 80; however other locations are contemplated, including on the housing 12. The tool condition indicators 104 are contemplated to include at least one of a visual indicator, an audible indicator, and a tactile indicator, such as a vibrating indicator. In the case of a visual indicator for the condition indicator 104, the indicator is contemplated to be in the form of at least one of a single LED, an LED bank and a screen. Information displayed or indicated by the indicator 104 includes tool temperature, number of fasteners remaining, status of battery charge, total fasteners driven, internal tool pressure, fastener driving pressure (regulator adjustment), or the like.

Figure 3:
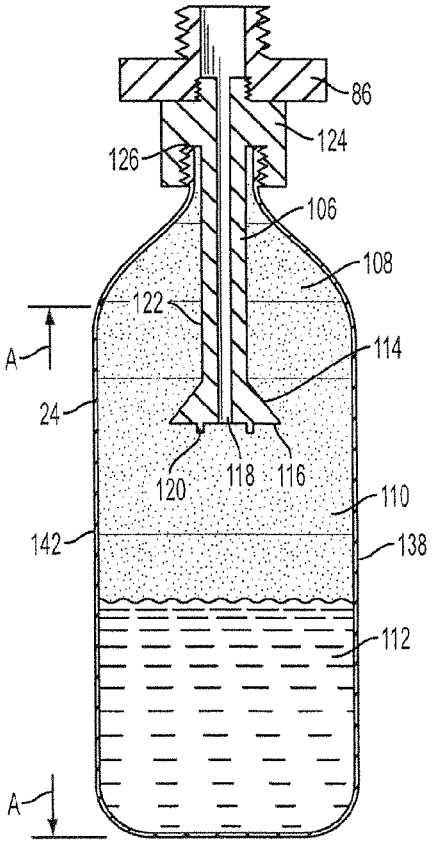
FIG. 3 is a vertical section of a suitable portable compressed fluid container for use with the present tool.
Figure 4A:
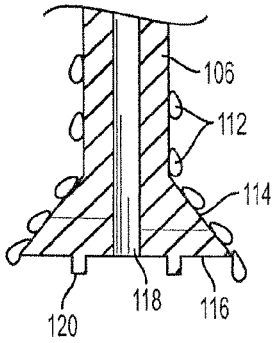
FIG. 4A is an enlarged fragmentary view of a siphon tube used in the fluid container of FIG. 3.
Figure 4B:
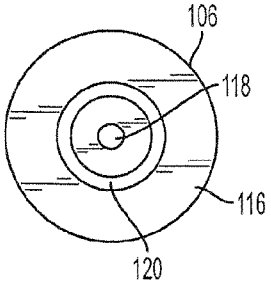
FIG. 4B is a bottom plan view of the siphon tube of FIG. 4A.

Referring now to FIGS. 3, 4A and 4B, when gas such as $CO_2$ is used as the power source, it is important for efficiency and power consistency to prevent liquid $CO_2$ from entering the inner chamber 26. Anti-siphon tubes are known in the art. These are typically installed in the vessel or container 24, which is often refillable, and are bent from a central axis vessel according to the desired bottle orientation. This requires "clocking" the tube after determining where the valve attachment threads stop on the top of the vessel. Proper orientation of the anti-siphon tube is a lengthy process and does not provide liquid free flow in all vessel orientations. Also, if the bent angle of the tube is improperly positioned, pressurized liquid may enter the tube, depending on the orientation of the tool. This problem is more prevalent when the tool 70 is used at odd angles for driving fasteners in areas with limited access.

Figure 8:
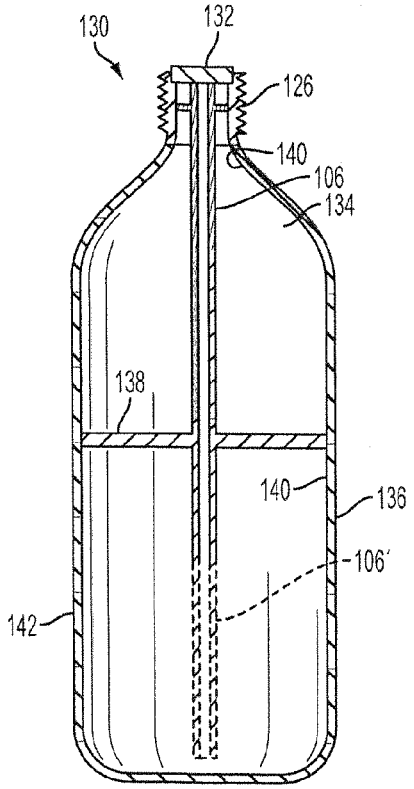
FIG. 8 is a vertical cross-section of the container of FIG. 7.

Accordingly, the pressurized fluid vessel or container 24 is preferably supplied with a tube 106, preferably an anti-siphon tube configured for depending into an interior chamber 108 of the tube. The purpose of the anti-siphon tube 106 is to prevent the flow of pressurized gas such as $CO_2$ in the liquid phase from being drawn into the tool inner chamber 26 or into the regulator 30 where it has been found to impair tool performance. This problem has been found to occur more frequently when conventional tools 10 are used at an angle to vertical, or are even inverted from the orientation depicted in FIG. 1. Preferably, the length of the anti-siphon tube 106 is approximately 33% to 66% of an effective interior axial length "A" of the container 24. More preferably, the length of the siphon tube 106 is approximately 50% of the effective interior axial length "A" of the container 24. It is contemplated that the length of the anti-siphon tube 106 is variable depending on the amount of liquid phase fluid in the container 24 at the initial or fill condition or state. Depending on the application, the tube 106 may be a siphon tube and thus extends almost the full effective length "A" at 106' (FIG. 8 shown in phantom) of the container 24 and into a liquid phase of the pressurized fluid.

More specifically, the pressurized gas in the container 24 is depicted as being in a gas phase 110 and a liquid phase 112. As the tool 10 is angled, the tendency for the liquid phase 112 to enter the intake conduit 28 or equivalent connection fitting 86 is increased. Accordingly, the present anti-siphon tube 106 is preferably provided with structure for impeding the flow of the liquid phase 112 into the tube. In the preferred embodiment, this structure takes the form of a flared, generally conical drip shelf 114 formed at a free end of the tube 106, a substantially closed bottom 116 with a relatively small intake opening 118, and at least one depending annular protective shield 120. These structures combine to impede the entry of pressurized gas in the liquid phase 112 into the tube 106. In addition, the anti-siphon tube 106 is provided with a tubular shank 122 used to calculate the desired length relative to the container effective length "A," regardless of whether or not the drip shelf 114 and the shield 102 are provided.

Opposite the intake opening 118, the anti-siphon tube 106 is connected to a closure 124 taking the form of a plug that sealingly engages an open neck 126 of the container 24. As shown, and particularly for use in refillable containers 24, the plug 124 is threadably engaged on the neck 126; however other attachment technologies are contemplated to retain the gas within the container 24 at the desired pressure.

Figure 5:
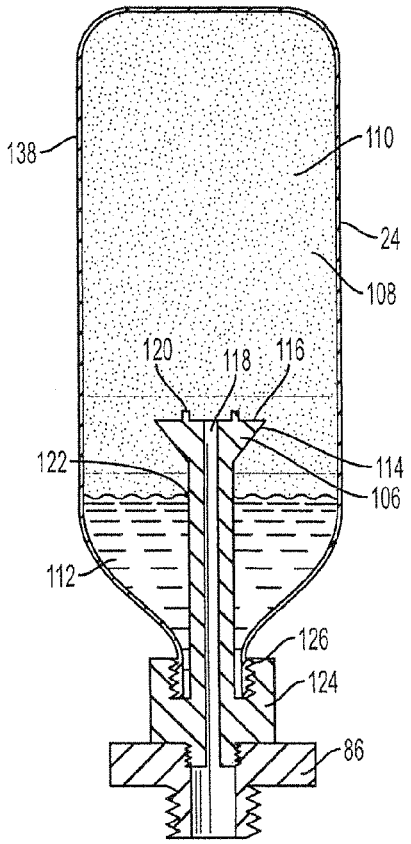
FIG. 5 is a vertical section of the gas source of FIG. 3 shown inverted.
Figure 6:
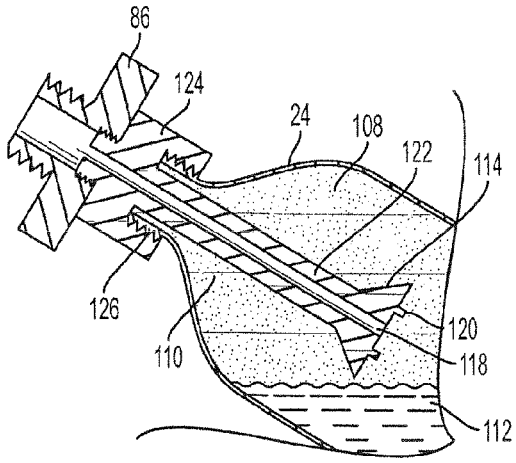
FIG. 6 is a fragmentary view of the fluid source of FIG. 3 shown disposed at an angle.

As seen in FIGS. 5 and 6, as the container 24 is angled or inverted, the latter position often used for refilling the container, the configuration of the anti-siphon tube 106 prevents the unwanted intake of pressurized gas in the liquid phase 112.

Figure 7:
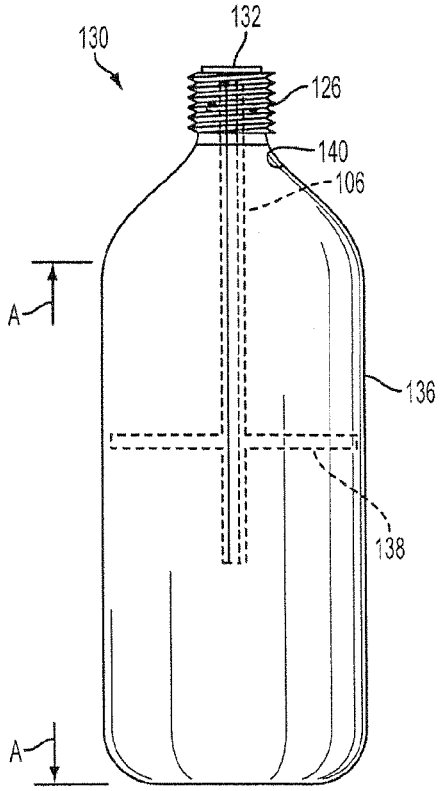
FIG. 7 is a side elevation of an alternate embodiment of the compressed fluid container of FIG. 3.

Referring now to FIGS. 7 and 8, an alternate embodiment of the container 24 is generally designated 130. Components shared with the container 24 are designated with identical reference numbers. The main difference between the containers 24 and 130 is that the former is refillable, and the latter is disposable. As such, the container 130 has a closure 132 taking the form of a cap that is sealably secured to the open neck 126. The anti-siphon tube 106 is fastened, as by welding, chemical adhesive, integrally formed such as by molding drawing of metal or the like to the cap 132, and depends into an internal chamber 134 of the container 130 defined by an outer shell 136.

As described above in relation to the container 24, the anti-siphon tube 106 extends between about 33% and 66% of the effective height "A" of the container, and more specifically about 50% of the effective height, but being variable as described above. For the purposes of the present invention, the "effective height" is measured internally from a bottom upward to a point where a largest diameter of the container 24 begins to narrow towards the neck 126. This length has been found to reduce the tendency for pressurized liquid within the container 130 to enter the tube. To support the tube 106 within the chamber 134, a bulkhead 138 extends radially from the tube and contacts an inner wall 140 of the chamber in a body portion 142 of the container.

Figure 10:
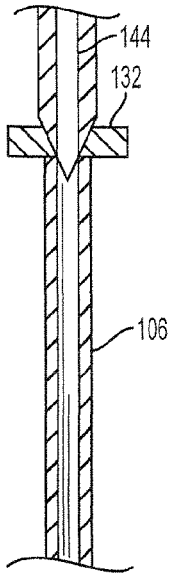
FIG. 10 is an enlarged fragmentary vertical cross-section of the container of FIG. 9 showing connection of the container to a tool.

Referring now to FIGS. 8 and 10, the cap 132 is preferably frangible, and, as is known in the art, is pierced by a pointed puncture device 144 in fluid communication with the inner housing chamber 26 by a conduit 28 or equivalent structure. It is contemplated that in the container 130, the tube 106 is optionally provided with at least one of the conical drip shelf 114, the substantially closed bottom end 116, the restricted opening 118 and the depending protective ring 120 as seen in FIGS. 4A, 4B.

Figure 9:
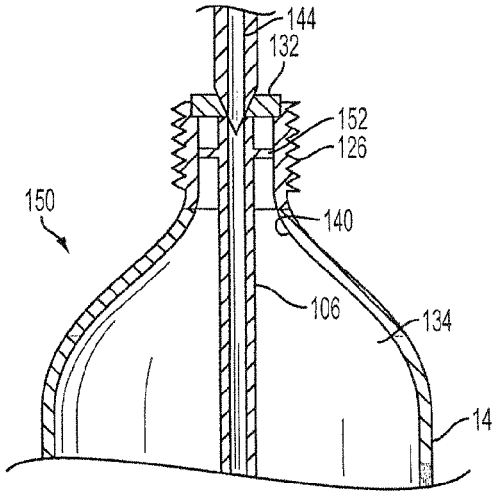
FIG. 9 is an enlarged fragmentary vertical cross-section of an alternate embodiment of the container of FIG. 7.

Referring now to FIG. 9, an alternate embodiment of the container 130 is generally designated 150. Components shared with the containers 24 and 130 are designated with identical reference numbers. A main difference between the containers 130 and 150 is that the latter has a bulkhead 152 extending radially from the anti-siphon tube 106 and engaging the inner wall 138 of the chamber 134 in the region of the neck 126, as opposed to the body portion 142. The container 150 is also optionally equipped with at least one of the conical drip shelf 114, the substantially closed bottom end 116, the restricted opening 118 and the depending protective ring 120 as seen in FIGS. 4A, 4B.

In the present tool 70 configured for sequential operation, the fastener driving cycle sequence is as follows with the tool at rest and a compressed gas vessel 24 attached. Next, the operator places the WCE 96 against the work surface and pulls the trigger 40. The switch 94 is electrically connected to the trigger 40, and once activated or energized, signals control circuitry or equivalent programming in the control system or microprocessor 76 to activate the firing sequence.

A signal is sent from the control circuit to open the solenoid valve 72. Upon opening, the valve 72 allows pressurized gas to flow from the container 24 to the regulator 30 where the pressure is reduced (typically to 80-500 psi). The gas then flows through the now open solenoid valve 72 and into the drive cylinder 34. Upon receipt of the flow of pressurized gas, the drive piston 36 then descends, comes in contact with the next fastener 20 to be driven, and then subsequently drives the fastener into the work surface.

If so equipped, the return spring 100 or other energy storing device installed on the underside of the piston 36 compresses to provide energy to urge the piston back to the initial position after the drive cycle is complete. Upon expiration of the control timing signal, adjustable via the user interface 80, the solenoid valve 72 closes, shutting off the supply of gas to the piston 36. It is contemplated that the valve 72 is closed before the piston 36 has completed its travel down the cylinder 34. Upon descending to the bottom of the cylinder 34, the piston 36 is returned to the initial position by the stored energy in the return spring 100. Alternately or in addition to the return spring 100, the partially expanded gas in the cylinder 34 above the piston 36 is allowed to exit from the cylinder volume above the piston and be routed to the underside of the piston. The solenoid valve 72 is allowed, through the exhaust valve 102, to vent the volume above the piston 36 to atmospheric pressure and to allow the force under the piston (spring, gas pressure or combination) to displace the piston back to the top of the cylinder 34.

Repetitive operation is also contemplated with the second switch 98 connected to the WCE 96. The control circuitry is set to the contact fire mode. The switch 98, in communication with the WCE 96, is activated by the operator pressing the WCE against the work surface after the trigger switch 94 is first activated. At this point, the driving sequence is initiated.

The disclosed anti-siphon tube 106 has a length of between 33% and 66% (50% length preferred for a fluid charge having less than 50% liquid charge in an initial state of the vessel 24) of the effective length "A" of the interior of the typical cylindrical vessel 24, and is preferably installed on the container axis. It will be understood that the length of the anti-siphon tube 106 is adjustable depending on the amount of liquid in the vessel at the initial, filled stage or condition. The described tube 106 allows the vessel 24 to be placed in virtually any orientation and exclude liquid from passing out of the vessel. With the addition of the drip shelf 114, liquid would be further excluded from entering the tube 106 after the vessel 24 is tipped over and then subsequently righted. The present tube end, including components 114, 116, 118, 120 prevents drops flowing down the tube from entering the tube inlet 118.

Figure 11:
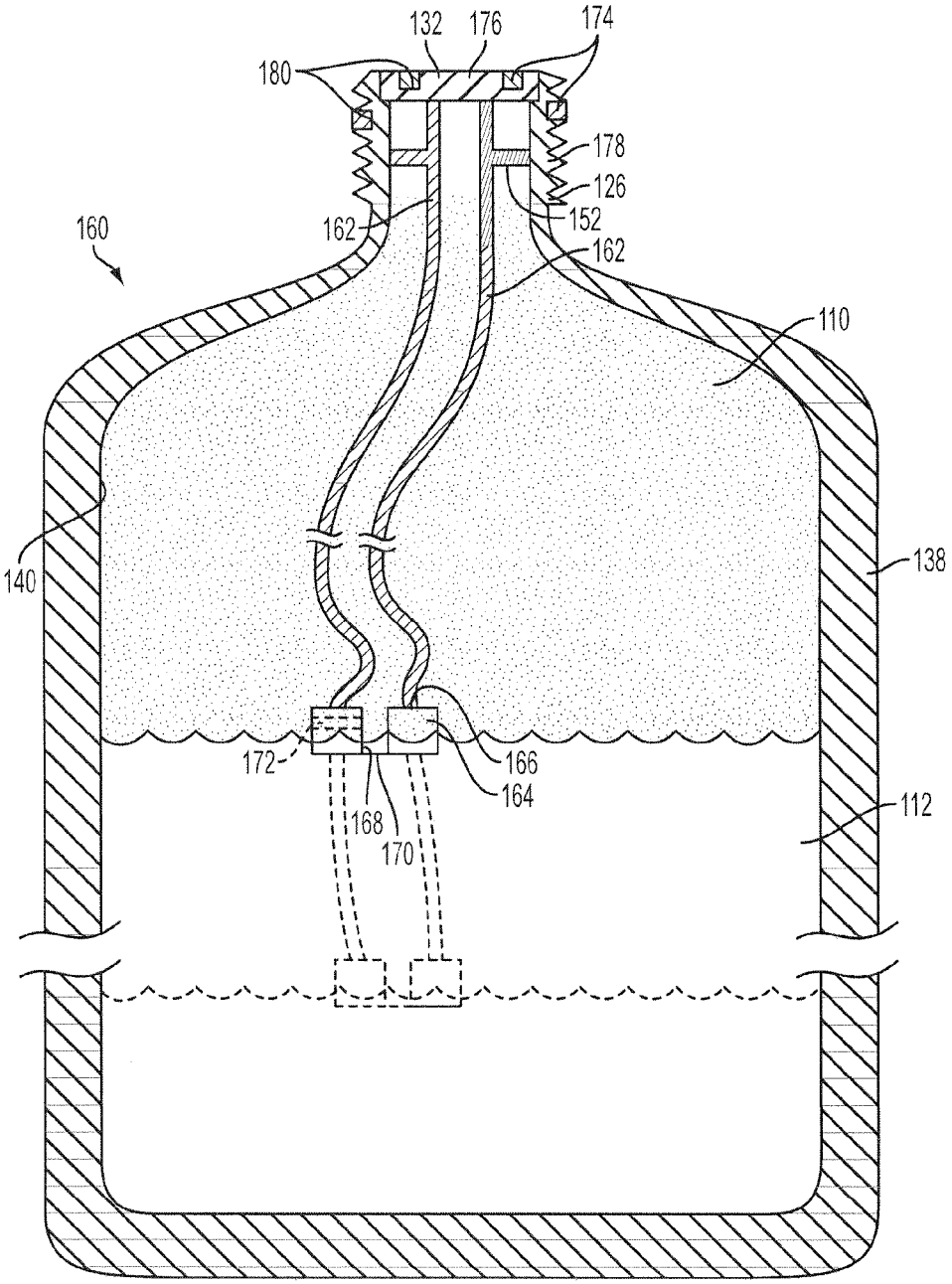
FIG. 11 is a fragmentary vertical section of another alternate embodiment of the container of FIG. 9.

Referring now to FIG. 11, another alternate embodiment of the present vessel is depicted and generally designated 160. Components shared with the vessel of 150 of FIG. 9, as well as the vessels 24 and 130 are designated with identical reference numbers. A significant difference of the vessel 160 from the others described above is that it is designed for applications where the desired fluid for operating the tool is the liquid phase 112. Dedicated features of the vessel 160 include providing a siphon tube 162 at least partially in a flexible format, such as manufactured of plastic or rubber tubing. In the embodiment depicted in FIG. 11, an upper portion of the tube 162 preferably passes through the bulkhead 152; however it is also contemplated to attach the tube directly to an underside of the cap 132.

In addition, a float 164 is fastened to a free end 166 of the siphon tube 162. The float 164 is made of a buoyant material as is known in the art, and is provided with an internal passageway 168 in fluid communication with the siphon tube 162 and having an inlet 170 in contact with the liquid fluid 112 in the vessel. The siphon tube 162 is provided in a sufficient length so that despite a wide variety of levels of liquid fluid 112 in the vessel 160, the float 164 will maintain contact with the liquid fluid to maintain a constant flow into the tube. It is also contemplated that the tube 162 is optionally an anti-siphon tube, in which case the inlet 170 is plugged and an alternate anti-siphon port 172 is provided that is in communication with gas phase 110 within the container 160.

Another feature of the vessel 160 is that the cap 132 is made of a metal disk fastened to the outer shell 136, as by welding or the like. To enhance the sealing relationship of the vessel 160 with the associated fitting on the tool 10, 70, at least one sealing member 174, such as an O-ring, a flange seal or the like, is disposed on at least one of an upper surface 176 of the cap, and on a threaded portion 178 of the neck 126. It will be appreciated that any such sealing member 174 is situated in an associated receptacle or groove 180 in the receiving structure. It will also be appreciated that such sealing members 174 are optionally provided in the vessels 24, 130 and 150.

While a particular embodiment of the present portable pressurized power source for fastener driving tool has been described herein, it will be appreciated by those skilled in the art that changes and modifications may be made thereto without departing from the invention in its broader aspects and as set forth in the following claims.

The invention claimed is:

1. A driver tool powered by compressed gas, comprising:
- a magazine associated with said tool for storing and supplying fasteners to a tool nose;
- a cylinder in said tool with a reciprocating piston attached to a driver blade sequentially engaging fasteners from the magazine as they are fed into said tool nose; and
- a compressed gas container in fluid communication with said reciprocating piston and having an anti-siphon tube that has at least one liquid entry prevention feature that includes at least one of a conically flared drip shelf, a substantially closed free end and a depending annular shield.

2. The tool of claim 1 wherein said anti-siphon tube has a length that is approximately 33% to 66% of an effective height of said container.

3. The tool of claim 1 wherein said container is one of disposable and reusable.

4. The tool of claim 1 including a control system configured such that a user interface displays or emits an alarm to the user to replace said container.

5. A driver tool powered by compressed gas, comprising:
- a magazine associated with said tool for storing and supplying fasteners to a tool nose;
- a cylinder in said tool with a reciprocating piston attached to a driver blade sequentially engaging fasteners from the magazine as they are fed into said tool nose; and
- a compressed gas container in fluid communication with said reciprocating piston and having an anti-siphon tube, wherein said anti-siphon tube has a length that is approximately 33% to 66% of an effective height of said container, the effective height is measured internally from a bottom of said container upward to a point where a largest diameter of the container begins to narrow towards a neck of the container.

* * * * *